US006082973A

United States Patent [19]

Dittmar et al.

[11] Patent Number: 6,082,973

[45] Date of Patent: Jul. 4, 2000

[54] LIQUID RING MACHINE HAVING A ROTOR WITH SWEEPING EDGES FOR SCRAPING-OFF DEPOSITS

[75] Inventors: Rudi Dittmar, Helmers; Norbert Schmid, Bad Neustadt, both of Germany

[73] Assignee: Siemens Aktiengesellschaft, Munich, Germany

[21] Appl. No.: 09/331,564

[22] PCT Filed: Dec. 8, 1997

[86] PCT No.: PCT/DE97/02859

§ 371 Date: Jun. 21, 1999

§ 102(e) Date: Jun. 21, 1999

[87] PCT Pub. No.: WO98/28542

PCT Pub. Date: Jul. 2, 1998

[30] Foreign Application Priority Data

Dec. 20, 1996 [DE] Germany ..... 196 53 746

[51] Int. Cl.[7] ..... F04C 19/00

[52] U.S. Cl. ..... 417/68; 417/430

[58] Field of Search ..... 417/68, 430; 418/46, 418/77

[56] References Cited

U.S. PATENT DOCUMENTS

| | | | |
|---|---|---|---|
| 1,525,332 | 2/1925 | Sommer | 417/68 |
| 1,668,532 | 5/1928 | Stewart | 417/68 |
| 2,771,860 | 11/1956 | Falk | 417/68 |
| 3,713,749 | 1/1973 | Fitch | 415/200 |
| 3,792,568 | 2/1974 | Gundlach et al. | 55/223 |
| 3,894,812 | 7/1975 | Huse | 417/68 |
| 4,112,688 | 9/1978 | Shaw | 60/669 |
| 4,360,318 | 11/1982 | Corvetto | 417/68 |
| 5,017,086 | 5/1991 | Hansen | 415/55.5 |
| 5,096,386 | 3/1992 | Kassel | 417/69 |
| 5,100,300 | 3/1992 | Haavik | 417/68 |
| 5,122,035 | 6/1992 | Juhola | 417/68 |
| 5,197,863 | 3/1993 | Dardis et al. | 417/68 |
| 5,213,479 | 5/1993 | Dardis et al. | 417/68 |
| 5,318,415 | 6/1994 | Verhoeven | 418/46 |
| 5,867,900 | 2/1999 | Larson et al. | 29/890.127 |

FOREIGN PATENT DOCUMENTS

| | | |
|---|---|---|
| 83 896 75 | 2/1977 | Australia . |
| 195 16 994 | 10/1996 | Germany . |
| 296 11 342 | 9/1997 | Germany . |
| WO 85/00637 | 2/1985 | WIPO . |

*Primary Examiner*—Charles G. Freay
*Assistant Examiner*—Robert Z. Evora
*Attorney, Agent, or Firm*—Kenyon & Kenyon

[57] ABSTRACT

A rotor for a liquid ring machine having a plurality of vanes connected to the rotor hub and a support disk, with the rotor hub face and the support disk back side having sealing surfaces. Recesses with formed edges, capable of scraping off material deposits, are located on the rotor hub face and the support disk back side.

6 Claims, 4 Drawing Sheets

LIQUID RING MACHINE HAVING A ROTOR WITH SWEEPING EDGES FOR SCRAPING-OFF DEPOSITS

FIELD OF THE INVENTION

The present invention relates to a rotor for a liquid ring machine.

BACKGROUND INFORMATION

A liquid ring machine is described in German Patent Application No. 195 169 94. In operating this machine with hard, i.e., limestone-containing, water, for example, limestone deposits are formed in the inner housing. In this case, the thickness of the limestone deposit increases depending on the temperature. A particularly critical stage is reached when, for example, the axial clearances between the rotor and the inner housing are filled with limestone. In operating the machine, in particular, in the case of longer shutdowns, the rotor may become jammed due to this limestone deposit or it may be axially displaced by hitting the limestone layer. This displacement of the rotor may also result in the rotor being eroded on the opposite side by the housing. Material failure or motor damage may result. The same may occur in the event of thickening corrosion layers.

So far, there have been no specific and effective measures against these phenomena for liquid ring machines. Chemical additives in the water or ionic accelerators may reduce limestone levels in this special case by chemically binding the limestone contained in the water or reducing calcium ions in the water added. In addition to being ecologically questionable, the cost of these measures is very high and they are also ill-suited to combat corrosion problems, for example.

SUMMARY

An object of the present invention is to reduce this layer growth on the inside of the housing of a liquid ring machine.

This object is achieved according to the present invention by providing at least one recess on the rotor hub face and/or on the support disk back side. The growing layers are scraped off due to the arrangements of recesses that form edges on the support disk back side and/or on the rotor hub face, and are transported outward with the operating liquid or discharged through the support disk slot. Thus the axial clearances cannot be completely filled with limestone to the point where the rotor is jammed or axially displaced. The total width of the recesses for forming edges is conveniently selected to be no larger than 2% of the rotor perimeter. Combinations of different recesses resulting in edges are possible. Thus, pocket holes can be combined with grooves and/or slots, as well as grooves with through holes. A substantially radial orientation of the recess for forming edges enlarges the surface to be swept. In order to obtain good clearance sealing even in high vacuum, the sealing surfaces of the support disk back side and the rotor hub face must have no radial holes.

Additional embodiments are described in the claims. With such modifications of the liquid ring machine, laboratory tests showed no negative effect on the pump characteristic, power consumption or noise generation of the liquid ring machine. In the following, the present invention is explained in detail with reference to an embodiment illustrated in the drawing.

DETAILED DESCRIPTION

Figure 1:
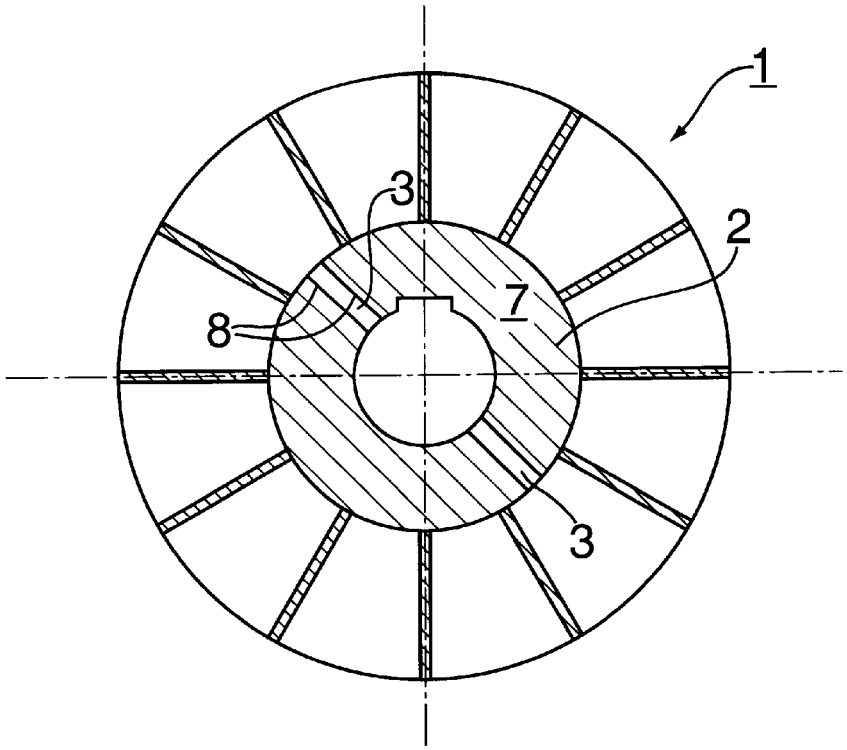
FIG. 1 shows grooves in the face of a rotor hub according to an example embodiment of the present invention.
Figure 2:
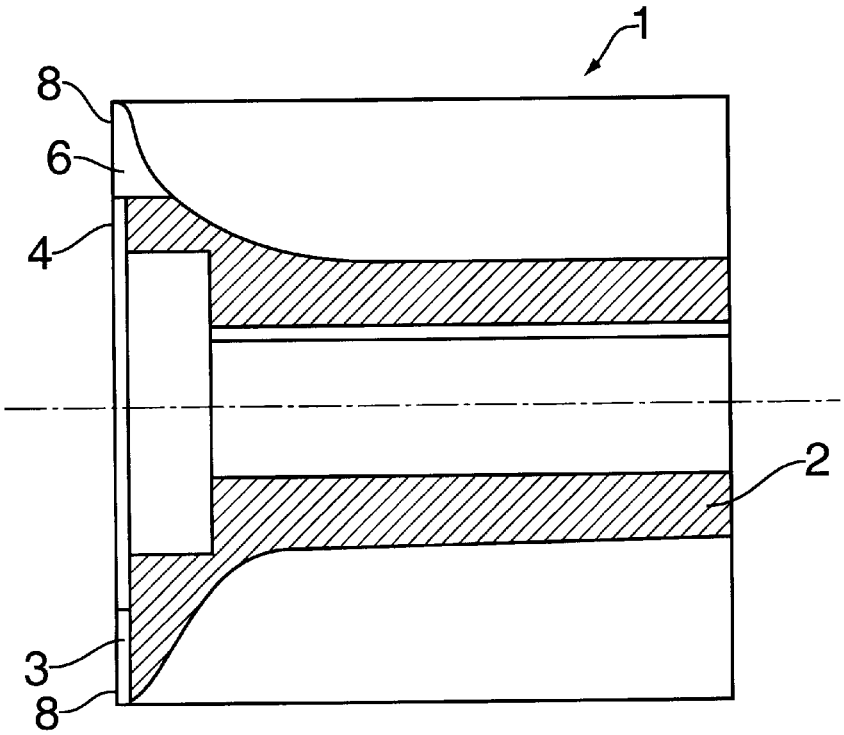
FIG. 2 shows a radial groove and a radial slot in the support disk back side.
Figure 3:
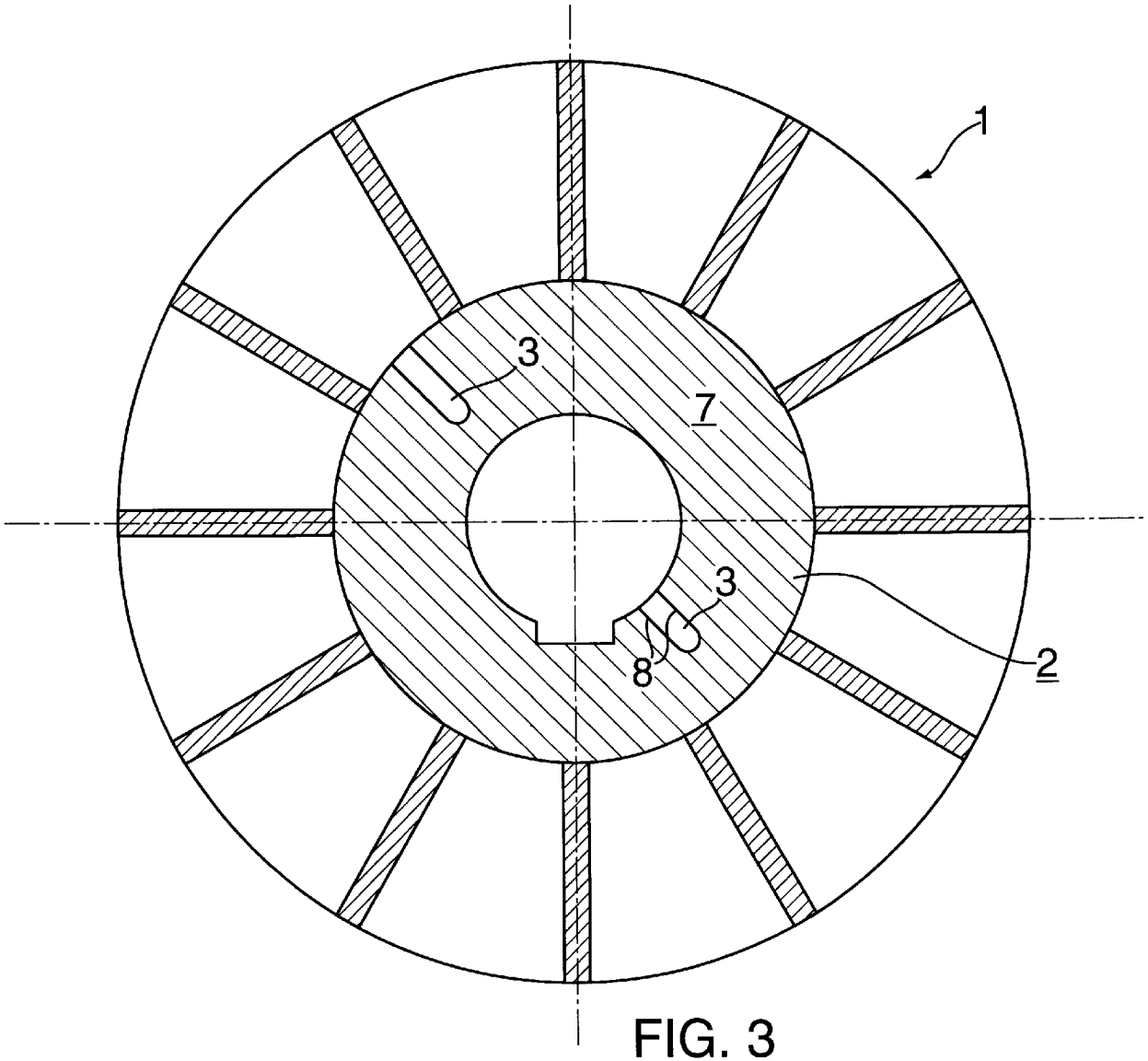
FIG. 3 shows offset grooves in the rotor hub face of a liquid ring machine for high vacuum.
Figure 4:
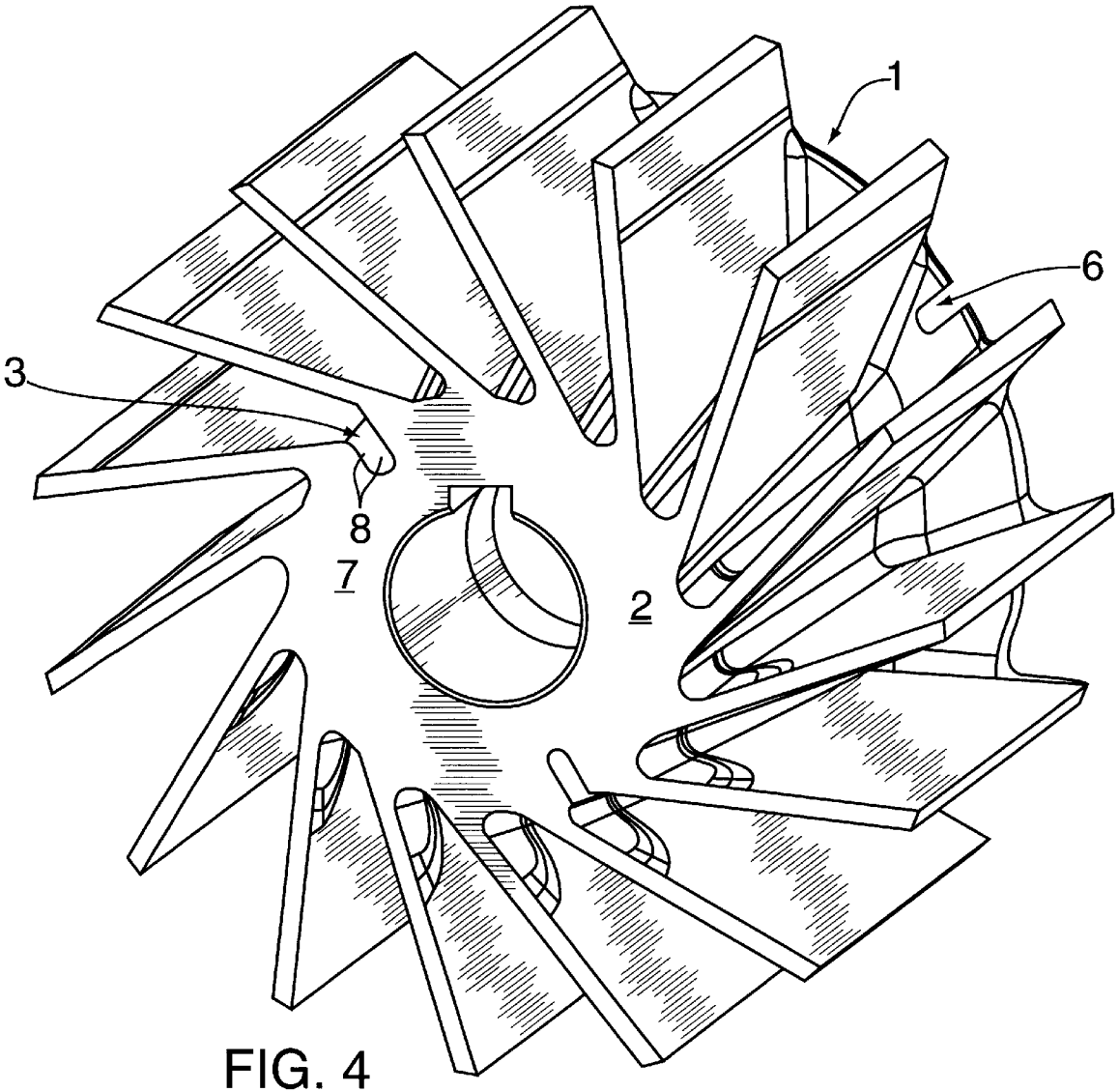
FIG. 4 shows a perspective view of the rotor (rotor hub front face in the foreground).
Figure 5:
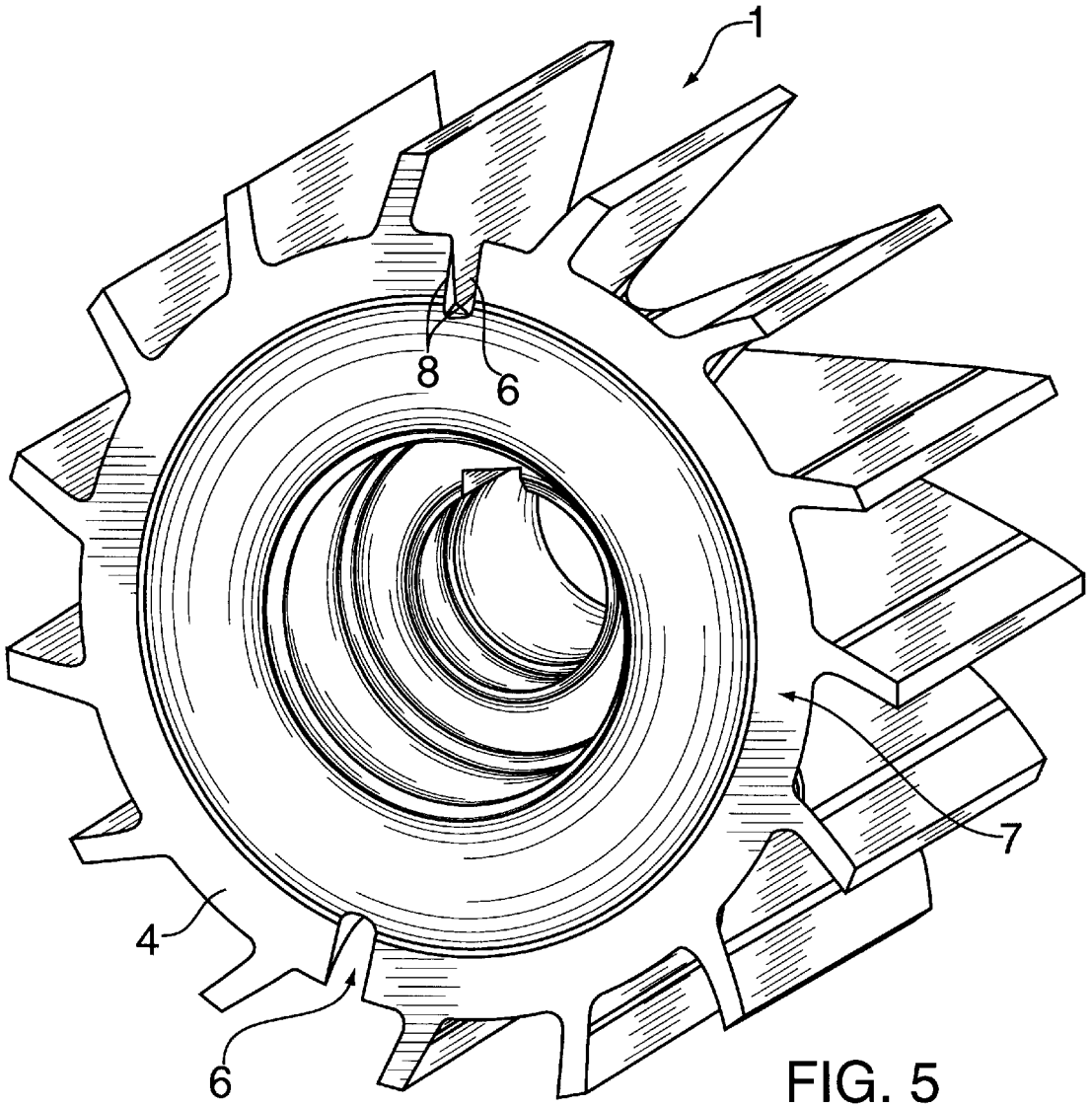
FIG. 5 shows a perspective view of the rotor (support disk back side in the foreground).

FIG. 1 shows a section through rotor 1 having grooves 3 on the face of rotor hub 2, which is designed as a sealing surface 7. FIG. 2 shows a longitudinal section through rotor 1, which has recesses 8 with formed edges on support disk back side 4; the recesses are in the form of slot 6 and groove 3 in this case. FIG. 3 shows a cross section through rotor 1, which has grooves 3 offset by 180° on rotor hub face 2; these grooves, however, do not fully pass through sealing surface 7 of rotor hub 1. FIGS. 4 and 5 show a perspective view of slots 6 in the support disk and grooves 3 in rotor hub face 2.

During the operation of the liquid ring machine, edges 8 of these slots 6 or grooves 3 continuously scrape off the growing layers of limestone or other undesirable material deposits (e.g., corrosion products) on the inside of the liquid ring machine housing. The scraped-off material is discharged by the operation radially outward and axially through the support disk slot. For special requirements, e.g. high vacuum, it is convenient not to provide sealing surfaces 7 of rotor hub 2 and support disk back side 4 with radial through grooves 3 or slots 6, but rather to arrange grooves 3 at an offset, as shown in FIG. 3. These grooves 3, arranged at an offset, may be designed so that they cover the same surfaces as radial through grooves 3.

What is claimed is:

1. A rotor for a liquid ring machine, comprising:

a housing;

a rotor hub positioned within the housing;

a plurality of vanes connected to the rotor hub; and a support disk supporting the rotor hub, a face of the rotor hub and a back side of the support disk having sealing surfaces, at least one of the face of the rotor hub, and the back side of the support disk having at least one recess for forming edges, the edges sweeping across a surface inside the housing during rotation of the rotor for scraping-off deposits.

2. The rotor according to claim 1, wherein the at least one recess for forming edges includes at least one of grooves and pocket holes.

3. The rotor according to claim 1, wherein the at least one recess for forming edges includes axial through holes.

4. The rotor according to claim 1, wherein the at least one recess for forming edges includes at least one of slots and bore holes.

5. The rotor according to claim 1, wherein the at least one recess for forming edges includes at least one of grooves and slots, the at least one of grooves and slots running in a substantially radial direction.

6. The rotor according to claim 5, wherein a radial dimension of the at least one of grooves and slots is less than a radial dimension of a respective sealing surface of the at least one of the face of the rotor hub and the back side of the support disk.

* * * * *